US007016618B2

(12) United States Patent
Jeong

(10) Patent No.: US 7,016,618 B2
(45) Date of Patent: Mar. 21, 2006

(54) METHOD OF DETECTING LIFESPAN OF TRANSFER ROLLER AND ELECTROPHOTOGRAPHIC IMAGE FORMING APPARATUS EMPLOYING THE METHOD

(75) Inventor: Su-Jong Jeong, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 171 days.

(21) Appl. No.: 10/693,939

(22) Filed: Oct. 28, 2003

(65) Prior Publication Data

US 2004/0136735 A1 Jul. 15, 2004

(30) Foreign Application Priority Data

Jan. 15, 2003 (KR) ..... 10-2003-0002811

(51) Int. Cl.
*G03G 15/00* (2006.01)
*G03G 15/16* (2006.01)

(52) U.S. Cl. ..... 399/24; 399/313

(58) Field of Classification Search ..... 399/44, 399/24, 31, 313, 176

See application file for complete search history.

(56) References Cited

U.S. PATENT DOCUMENTS 5,784,668 A * 7/1998 Hyakutake et al. ..... 399/44

FOREIGN PATENT DOCUMENTS

JP 04274272 A * 9/1992
JP 05027614 A * 2/1993
JP 08211691 A * 8/1996

* cited by examiner

*Primary Examiner*—Susan Lee
(74) *Attorney, Agent, or Firm*—Staas & Halsey LLP

(57) ABSTRACT

An electrophotographic image forming apparatus and method. The apparatus has a laser scanning unit to generate a laser beam, a photosensitive medium to receive the laser beam and form an electrostatic latent image, a developing roller to attach toner to a surface of the photosensitive medium, a transfer roller to transfer the developed image onto a paper sheet, a charge roller to charge the surface of the photosensitive medium to have a predetermined voltage, a power supply to supply electric power to the transfer roller and the charge roller, a transfer roller resistance detecting unit to detect a resistance of the charge roller, an actual surrounding condition detecting unit to detect an actual surrounding condition of the charge roller, and a controller to detect a surrounding condition from the resistance of the charge roller, compare the detected surrounding condition with the actual surrounding condition, and generate a transfer roller exchange signal if the two surrounding conditions differ.

36 Claims, 5 Drawing Sheets

METHOD OF DETECTING LIFESPAN OF TRANSFER ROLLER AND ELECTROPHOTOGRAPHIC IMAGE FORMING APPARATUS EMPLOYING THE METHOD

CROSS-REFERENCE TO RELATED APPLICATIONS

This application claims the priority of Korean Patent Application No. 2003-2811, filed Jan. 15, 2003, in the Korean Intellectual Property Office, the disclosure of which is incorporated herein by reference.

BACKGROUND OF THE INVENTION

1. Field of the Invention

The present invention relates to an electrophotographic image forming apparatus, and more particularly, to a method of detecting a lifespan of a transfer roller in an electrophotographic image forming apparatus, and the electrophotographic image forming apparatus employing the method.

2. Description of the Related Art

As is generally known in the art, in an electrophotographic image forming apparatus, light is shed on a photosensitive medium to form an electrostatic latent image, a developing agent is applied to the electrostatic latent image to form a visual image, the visual image is transferred to a paper sheet, and the paper sheet with the visual image printed thereon is then output.

FIG. 1 illustrates a conventional electrophotographic image forming apparatus. As shown in FIG. 1, the conventional electrophotographic image forming apparatus 100 includes a laser scanning unit 110 to generate a laser beam, a photosensitive drum 120 on which an electrostatic latent image is formed, and a developing roller 130 to supply toner to the photosensitive drum 120 to form an electrostatic latent image. The apparatus 100 further includes a transfer roller 140 to transfer a visible image, which is the developed form of the electrostatic latent image of the photosensitive drum 120, onto a paper sheet, a charge roller 150 to charge the surface of the photosensitive drum 120 to a predetermined potential, a power supply 160 to supply a high voltage to the respective parts, a controller 170 to control the operation of the respective parts, and a discharge sensor 180 to detect whether the printed image is discharged or not.

In the conventional electrophotographic image forming apparatus 100 having the construction described above, when the laser beam generated in the laser scanning unit 110 is incident on the surface of the photosensitive drum 120, an electrostatic latent image is formed on a portion of the surface of the photosensitive drum 120. Then, toner supplied from the developing roller 130 is attached to the portion of the photosensitive drum 120 having the electrostatic latent image thereon, to form a visual image, which is then transferred onto a paper sheet by the transfer roller 140 applied with the high voltage from the power supply 160. After the transfer is completed, the toner remaining on the surface of the photosensitive drum 120 is eliminated by a cleaning blade 121.

Meanwhile, in the image forming apparatus 100 as described above, in order to transfer the negatively-charged toner clinging to the photosensitive drum 120 onto the paper sheet, the power supply 160 applies high voltage (e.g., 600 to 4200 volts) to the transfer roller 140, which is made of a conductive sponge, thereby forming a predetermined electric potential difference between the photosensitive drum 120 and the transfer roller 140. In this case, since the transfer roller 140 has a resistance increasing in proportion to the amount of time during which electricity is applied to the transfer roller 140, it is impossible to produce a quality image after the transfer roller 140 has been in use for too long. Therefore, the transfer roller 140 must be replaced after being used for a long time, and the controller 170 judges the time to replace the transfer roller 140 and displays the time for a user to see.

FIG. 2 is a flowchart illustrating a method of detecting a lifespan of the transfer roller 140 in the conventional electrophotographic image forming apparatus 100. First, when printing is initiated and a paper sheet is supplied from outside (S10), the controller 170 examines if a printed paper sheet has been discharged or not (S11). In this case, when a printed paper sheet has been discharged, one is added to an existing number n of total printed paper sheets (S12) and a new number n of total printed paper sheets is then compared with a critical number N (e.g., 100,000 or 150,000) of paper sheets which can be printed by the transfer roller 140 (S13). When n is less than or equal to N, the controller 170 determines if the apparatus will continue the printing or not (S15). According to this determination, the controller 170 issues a command to feed paper or a command to stop the printing.

In contrast, when n is greater than N, the controller 170 controls a display unit (not shown) disposed on a body of the image forming apparatus 100 to indicate that it is time to replace the transfer roller 140 (S14).

However, the conventional electrophotographic image forming apparatus 100, in which the lifespan of the transfer roller 140 is judged by the number n of the total printed paper sheets, cannot determine the exact lifespan of the transfer roller 140, because it does not factor the variation in the resistance of the transfer roller 140 according to the number of print jobs, which may change according to printing conditions. In other words, when a continuous printing operation lasts for a long time, resistance of the transfer roller 140 rapidly increases. As a result, even before the number n of the total printed paper sheets reaches the critical number N, the increased resistance of the transfer roller 140 may cause the printing quality to deteriorate. In contrast, when printing is intermittently carried out, there may be only a small increase in the resistance of the transfer roller 140 even after the number n of the total printed paper sheets reaches the critical number N, thereby enabling a good printing quality to be obtained.

As a result, in the conventional electrophotographic image forming apparatus 100 as described above, even when the lifespan of the transfer roller 140 expires and the transfer roller 140 should be replaced, the time to replace the transfer roller 140 may have already passed, causing the printing quality to deteriorate. On the other hand, if the lifespan of the transfer roller 140 has not yet expired, an unnecessary replacement increases the expense in maintaining the image forming apparatus.

SUMMARY OF THE INVENTION

Accordingly, it is an aspect of the present invention to provide a method of detecting a lifespan of a transfer roller and an electrophotographic image forming apparatus employing the method, which can exactly detect the time to exchange the transfer roller. The apparatus is replaced at a time when the printing quality begins to deteriorate due to an increase in resistance of the transfer roller, by considering printing conditions.

Additional aspects and advantages of the invention will be set forth in part in the description which follows and, in part, will be obvious from the description, or may be learned by practice of the invention.

The foregoing and/or other aspects are achieved by providing an electrophotographic image forming apparatus including a laser scanning unit to generate a laser beam; a photosensitive medium on which the laser beam is incident to form an electrostatic latent image; a developing roller to attach toner to a surface of the photosensitive medium to develop the electrostatic latent image; a transfer roller to transfer the developed image to a paper sheet; a charge roller to charge the surface of the photosensitive medium to a predetermined voltage; a power supply to supply electric power to the transfer roller and the charge roller; a transfer roller resistance detecting unit to detect a resistance of the charge roller; an actual surrounding condition detecting unit to detect an actual surrounding condition of the charge roller; and a controller to detect a surrounding condition from the resistance of the charge roller, compare the detected surrounding condition with the actual surrounding condition, and generate a transfer roller exchange signal if the detected surrounding condition is not the same as the actual surrounding condition.

The electrophotographic image forming apparatus may include a display unit to indicate a time for a transfer roller exchange in response to the transfer roller exchange signal input from the controller.

The surrounding condition may be temperature or humidity. The transfer roller resistance detecting unit may be an ammeter or a voltmeter, which are installed on a power supply line between the power supply and the transfer roller.

The actual surrounding condition detecting unit may be a charge roller resistance detecting unit to detect the resistance of the charge roller, and may be a voltmeter or an ammeter, which are installed on a power supply line between the power supply and the charge roller.

The actual surrounding condition detecting unit may be a thermometer to detect a temperature in the vicinity of the transfer roller. The actual surrounding condition detecting unit may include a paper discharge sensor to sense a discharge of a printed paper sheet.

The foregoing and/or other aspects of the present invention are also achieved by providing a method of detecting a life span of a transfer roller of an electrophotographic image forming apparatus, including detecting a surrounding condition of the transfer roller; detecting an actual surrounding condition of the transfer roller; comparing the surrounding condition with the actual surrounding condition; and generating a transfer roller exchange signal based upon the comparing, including generating the transfer roller exchange signal if the surrounding condition differs from the actual surrounding condition.

The transfer roller life span detecting method may also include indicating a time for a transfer roller exchange in response to an input of the transfer roller exchange signal.

The surrounding condition may be temperature or humidity. Furthermore, the surrounding condition may be detected from a resistance, an electric current value, or a voltage value of the transfer roller. Also, the actual surrounding condition may be detected from a resistance, an electric current value, or a voltage value of a charge roller.

Prior to the surrounding condition detecting operation, there may be an operation of comparing a total number of printed pages with a threshold for a minimum number of printed pages.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
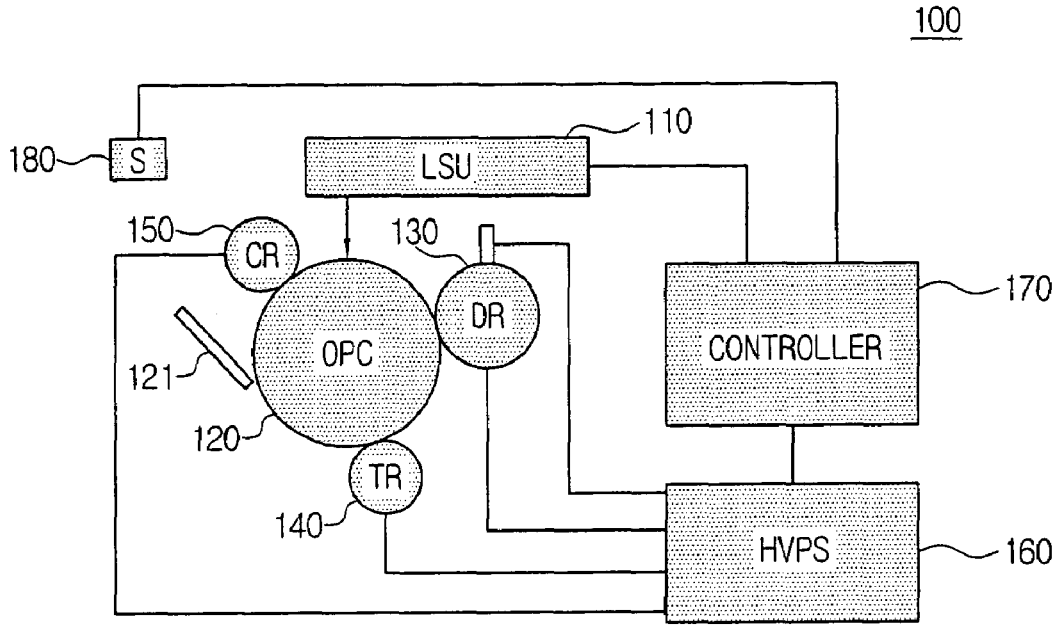
FIG. 1 (PRIOR ART)
FIG. 1 is a block diagram schematically showing a construction of a conventional electrophotographic image forming apparatus.
Figure 2:
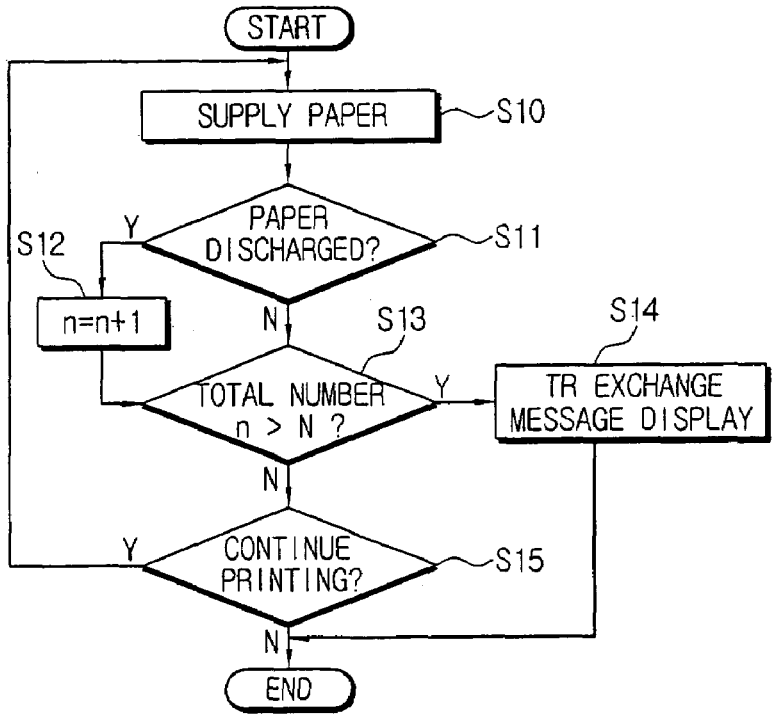
FIG. 2 (PRIOR ART)
FIG. 2 is a flowchart illustrating a conventional method of detecting a lifespan of a transfer roller in an electrophotographic image forming apparatus.

Reference will now be made in detail to the present preferred embodiments of the present invention, examples of which are illustrated in the accompanying drawings, wherein like reference numerals refer to like elements throughout.

Figure 3:
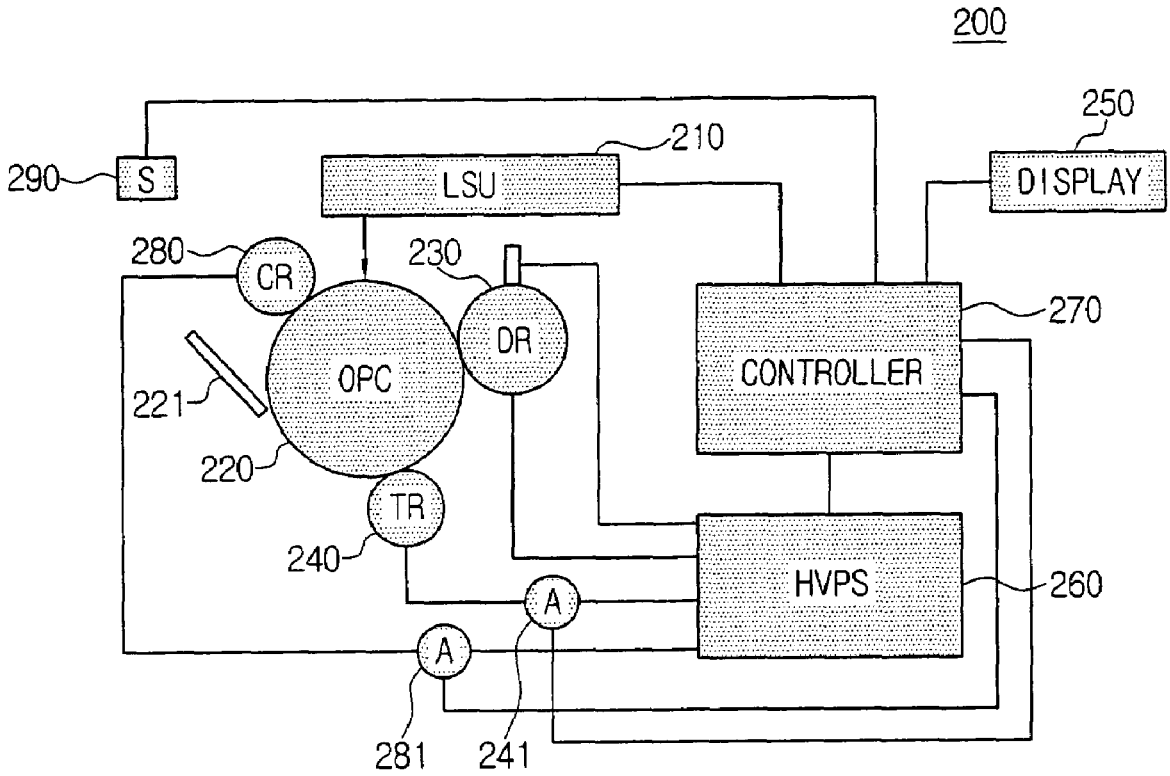
FIG. 3 is a block diagram schematically showing a construction of an electrophotographic image forming apparatus according to a first embodiment of the present invention.

As shown in FIG. 3, an electrophotographic image forming apparatus 200 according to a first embodiment of the present invention includes a laser scanning unit 210 to generate a laser beam, a photosensitive drum 220 onto which the laser beam is incident to form an electrostatic latent image, a developing roller 230 to supply toner to the photosensitive drum 220 so as to develop the electrostatic latent image, and a transfer roller 240 to transfer the visual image developed on a surface of the photosensitive drum 220 onto a paper sheet. The apparatus 200 also includes a display unit 250 to display various pieces of information according to the printing operation, a power supply 260 to supply electric power to each element, a controller 270 to control an operation of each element, a charge roller 280 to charge the surface of the photosensitive drum 220 to have a predetermined voltage, and a discharge sensor 290 to detect the total number of printed paper sheets.

In the electrophotographic image forming apparatus 200, when the laser beam generated in the laser scanning unit 210 is incident on the surface of the photosensitive drum 220, an electrostatic latent image is formed on a portion of the surface of the photosensitive drum 220, at which the laser beam arrives. Then, toner supplied from the developing roller 230 is attached to the portion having the electrostatic latent image thereon so as to form a visual image, which is then transferred onto a paper sheet in a transferring nip between the photosensitive drum 220 and the transfer roller 240. After the transfer is completed, the toner remaining on the surface of the photosensitive drum 220 is eliminated by a cleaning blade 221, and the surface of the photosensitive drum 220 is charged again to have a predetermined voltage by the charge roller 280. Furthermore, the discharge sensor 290 detects a discharge of a printed paper sheet and sends the discharge information to the controller 270.

Figure 4:
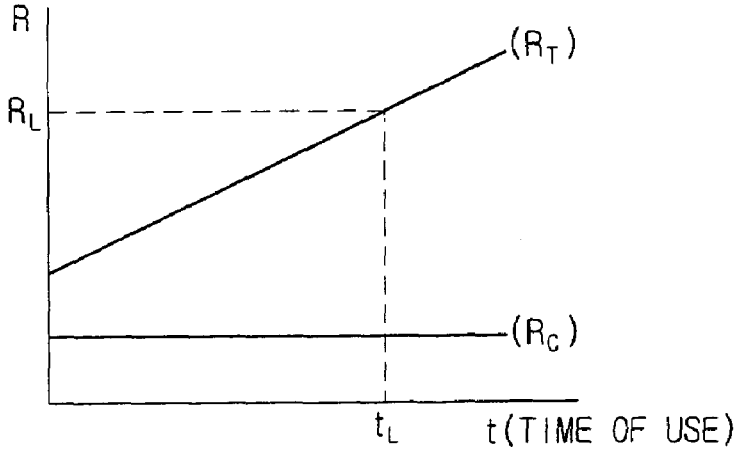
FIG. 4 is a graph showing a change of resistance of the transfer roller according to the time of use according to the embodiments of the present invention.

Meanwhile, in order to transfer the negatively-charged toner, (clinging to and forming the visual image on the photosensitive drum 220) from the photosensitive drum 220 to the paper sheet, the power supply 260 applies a high voltage (e.g., 600 to 4200 volts) to the transfer roller 240, which is made of a conductive sponge. As shown in FIG. 4, the transfer roller 240 has a resistance $R_T$ which increases over time of use of the transfer roller 240. When the resistance of the transfer roller 240 has increased to a predetermined magnitude, and the time of use of the transfer roller 240 reaches a critical time limit $t_L$, the transfer performance is lowered and printing quality deteriorates. Therefore, it can be said that the lifespan of the transfer roller 240 expires when the resistance $R_T$ of the transfer roller 240 reaches a critical resistance $R_L$ corresponding to the usage time limit $t_L$. For this reason, a first ammeter 241 capable of detecting electric current may be provided at a power supply line to the transfer roller 240, so as to obtain the resistance $R_T$ of the transfer roller 240.

However, since the detected resistance $R_T$ of the transfer roller 240 is influenced greatly by surrounding conditions in the area of the transfer roller 240, such as temperature or humidity, the detected resistance $R_T$ of the transfer roller 240 alone is insufficient to exactly understand the state of the transfer roller 240. That is, as noted in the graph shown in FIG. 5, the detected resistance $R_T$ decreases as the surrounding temperature T increases. Therefore, in order to exactly estimate the lifespan of the transfer roller 240, a method should consider surrounding conditions in the area of the transfer roller 240.

Figure 5:
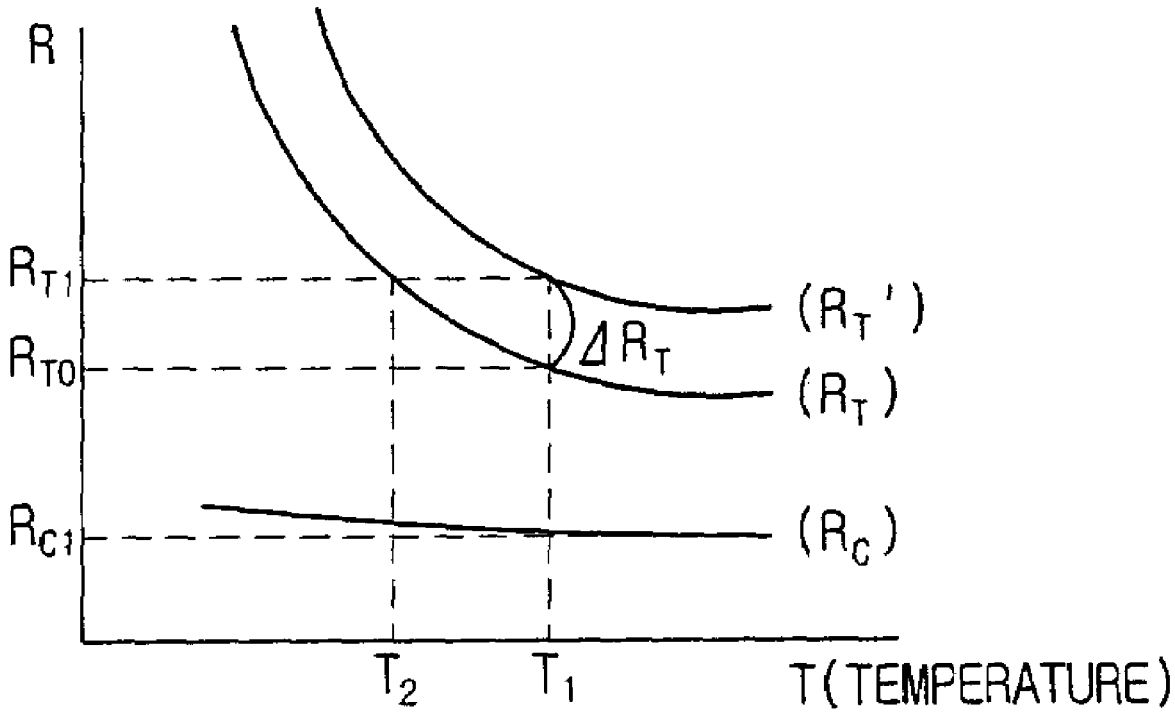
FIG. 5 is a graph showing a change of detected resistances of the transfer roller and the charge roller according to the surrounding temperature according to the embodiments of the present invention.

The electrophotographic image forming apparatus 200 is structured so as to detect the information about actual surrounding conditions, and includes a unit to detect, in this instance, a temperature, which, among all the surrounding conditions, influences the resistance $R_T$ the most. The charge roller 280 and a second ammeter 281 capable of detecting electric current of the charge roller 280, may be utilized as said unit to detect the actual reference temperature. As shown in FIGS. 4 and 5, the charge roller 280 has a resistance $R_C$ which is much smaller than the resistance $R_T$ of the transfer roller 240 and shows insignificant change over the time of use. Therefore, when the resistance $R_C$ of the charge roller 280 is known, the real temperature around the transfer roller 240 can be detected with the data shown in the graph of FIG. 5.

Hereinafter, a method of detecting a lifespan of a transfer roller in an electrophotographic image forming apparatus according to the embodiments of the present invention will be described with reference to FIGS. 3 to 6.

Figure 6:
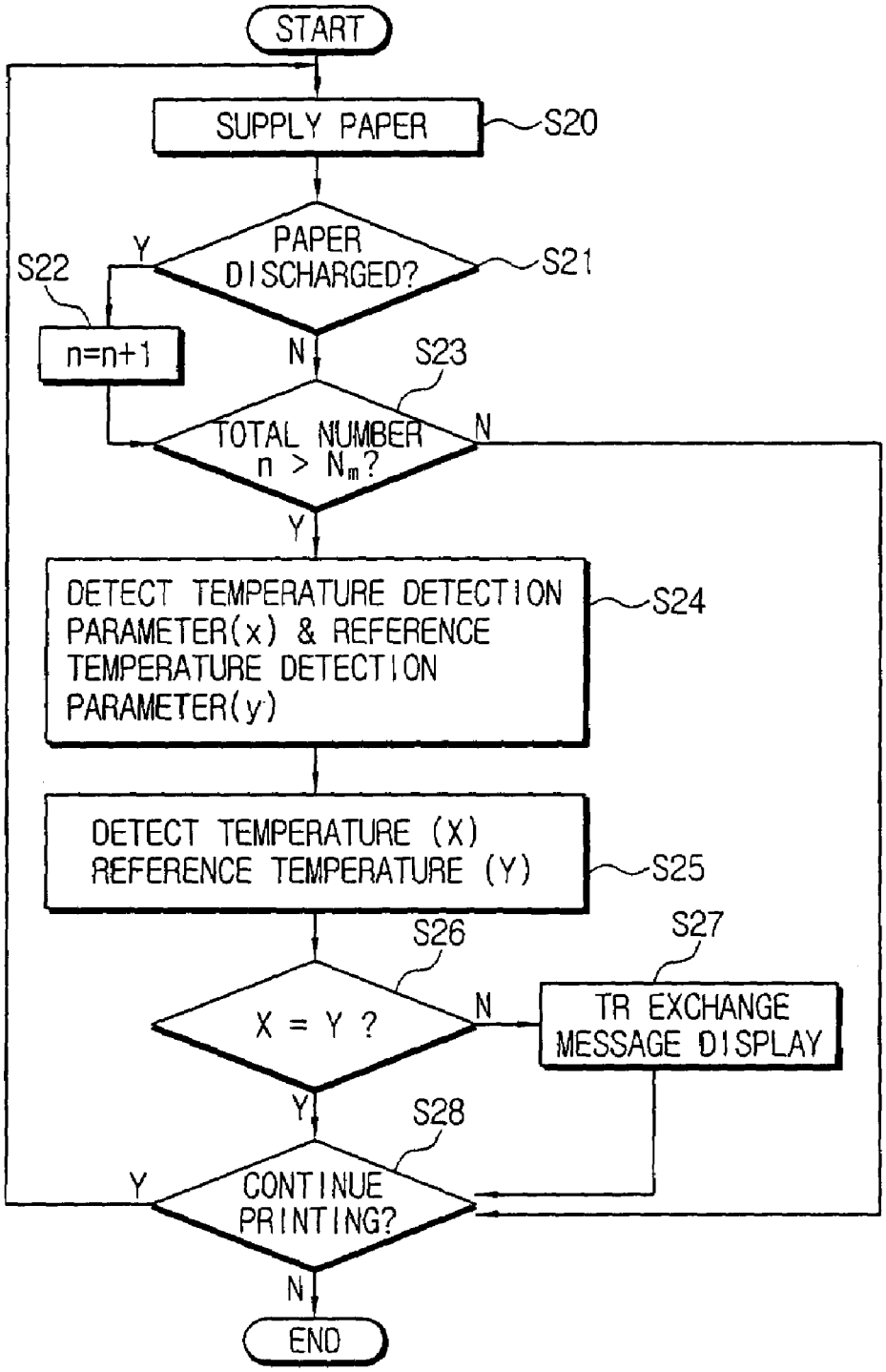
FIG. 6 is flowchart illustrating a method of detecting a lifespan of a transfer roller in an electrophotographic image forming apparatus according to the embodiments of the present invention.

As shown in FIG. 6, when printing is initiated and a paper sheet is supplied (S20), the controller 270 examines if a printed paper sheet has been discharged or not (S21) and renews information about the total number n of printed paper sheets (S22). Then, the controller 270 compares the total number n of printed paper sheets with a minimum critical number $N_m$ of printed paper sheets (S23). In this case, the minimum critical number $N_m$ of printed paper sheets may be set as a number for ensuring the shortest possible lifespan of the transfer roller 240, that is, the least number of paper sheets which can be printed before the printing quality deteriorates from the increase in the resistance of the transfer roller 240 in a situation where printing is continuously carried out. When the total number n of printed paper sheets is greater than the minimum critical number $N_m$, the controller 270 obtains as a temperature detection parameter x, from the electric current applied to the transfer roller 240, which has been detected by the first ammeter 241, and obtains the resistance $R_C$ of the charge roller 280 as a reference temperature detection parameter y, from the electric current applied to the charge roller 280, which has been detected by the second ammeter 281 (S24). Thereafter, the controller 270 estimates a temperature X and a reference temperature Y from the two detection parameters x and y (S25) and compares the two temperatures X and Y (S26).

In this case, since the resistance $R_C$ of the charge roller 280 is nearly independent from the time of use and changes only according to the surrounding conditions, it can be said that the reference temperature Y estimated from the resistance $R_C$ obtained from the detected electric current is an actual temperature in the area of the transfer roller 240 and is referred to as an actual surrounding condition. Therefore, if the temperature X obtained from the resistance $R_T$ of the transfer roller 240 is different from the reference temperature Y, it can be concluded that the resistance of the transfer roller 240 has increased.

As can be noted in more detail from the graph of FIG. 5, when the detected resistance $R_c$ of the charge roller 280 is $R_{c1}$, the reference temperature Y for the surrounding temperature of the transfer roller 240 is $T_1$. Further, when the detected resistance $R_T$ of the transfer roller 240 is $R_{T1}$, the temperature X for the surrounding temperature is $T_2$. In this case, the temperature X does not coincide with the reference temperature Y, because the resistance of the transfer roller 240 has increased and thus the transfer roller 240 has a changed resistance $R_T'$, which is different from the resistance $R_T$ of the transfer roller 240 in a normal state. It is understood that the resistance of the transfer roller 240 has increased by $\Delta R_T$, since the resistance $R_T$ of the transfer roller 240 at the temperature $T_1$ in a normal state is actually $R_{T0}$.

Therefore, when the reference temperature Y and the temperature X are different from each other, the controller 270 controls the display unit 250 to display a message indicating it is time to change the transfer roller 240 (S27) and judges whether it will continue the printing or not (S28).

Although temperature is described as one example of the surrounding condition in the above-described embodiment, other surrounding conditions, such as humidity, that influence the resistance of the charge roller 280 can also be used as the surrounding condition.

Further, although the resistances $R_T$ and $R_C$ derived from the electric currents detected by the first and second ammeters 241 and 281 are utilized as the temperature detection parameter x and the reference temperature detection parameter y in the embodiment described above, the lifespan of the transfer roller 240 can be detected without obtaining the resistances $R_T$ and $R_C$, if data about changes of electric current in the transfer roller 240 and the charge roller 280 according to temperature change are utilized.

Further, although the first and second ammeters 241 and 281 are utilized as units to detect the temperature detection parameter x and the reference temperature detection parameter y in the embodiment described above, the resistances $R_T$ and $R_C$ of the transfer roller 240 and the charge roller 280 can be detected by installing voltmeters (not shown) instead of the ammeters 241 and 281 on the power supply lines to the transfer roller 240 and the charge roller 280.

Also, in the case of utilizing the voltmeters, the time to exchange the transfer roller 240 can be detected without obtaining the resistances $R_T$ and $R_C$, if data about changes of voltages of the transfer roller 240 and the charge roller 280 according to temperature change can be utilized.

Figure 7:
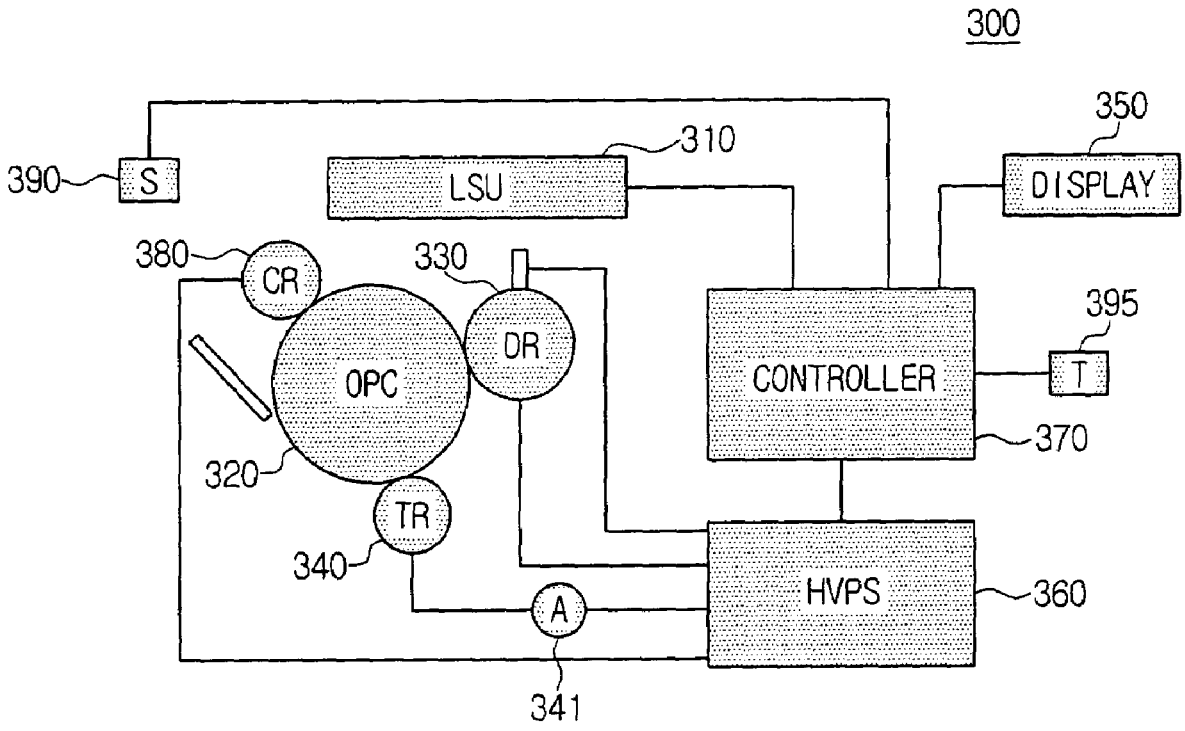
FIG. 7 is a block diagram schematically showing a construction of an electrophotographic image forming apparatus according to a second embodiment of the present invention.

FIG. 7 illustrates an electrophotographic image forming apparatus according to a second embodiment of the present invention. The electrophotographic image forming apparatus 300 has a construction similar to that of the electrophotographic image forming apparatus 200.

As shown in FIG. 7, the electrophotographic image forming apparatus 300 includes a laser scanning unit 310 to generate a laser beam, a photosensitive drum 320 onto which the laser beam is incident to form an electrostatic latent image, a developing roller 330 to supply toner to the photosensitive drum 320 so as to develop the electrostatic latent image, and a transfer roller 340 to transfer the visual image developed on a surface of the photosensitive drum 320 onto a paper sheet. The apparatus 300 further includes a display unit 350 to display various information according to the printing operation, a power supply 360 to supply electric power to each element, a controller 370 to control the operation of each element, a charge roller 380 to charge the surface of the photosensitive drum 320 to have a predetermined voltage, a discharge sensor 390 to detect the total number of printed paper sheets, and a thermometer 395 to detect a temperature in the area of the transfer roller 340. Further, an ammeter 341 is provided at a power supply line between the transfer roller 340 and the power supply 360.

The method of detecting life span of the charge roller 340 is almost identical to that of the electrophotographic image forming apparatus 200, except that the detecting method for the apparatus 300 detects the temperature X from the thermometer 395.

In the embodiments of the present invention as described above, even printing conditions which can change variation in the increase of resistance of the transfer roller 240 are considered, so that the time to exchange the transfer roller 240 can be exactly detected. Therefore, the embodiments of the present invention overcome problems of the prior art in which the time to exchange the transfer roller 240 may be missed, causing the printing quality to deteriorate, or to be performed too soon, causing excessive maintenance costs.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A method of detecting a life span of a transfer roller of an electrophotographic image forming apparatus, the method comprising:

detecting a surrounding condition of the transfer roller;

detecting an actual surrounding condition of the transfer roller;

comparing the surrounding condition with the actual surrounding condition; and generating a transfer roller exchange signal based upon the comparing, comprising generating the transfer roller exchange signal if the surrounding condition differs from the actual surrounding condition.

2. The method of claim 1, further comprising indicating a time for a transfer roller exchange in response to the transfer roller exchange signal.

3. The method of claim 1, wherein the surrounding condition is a temperature.

4. The method of claim 1, wherein the surrounding condition is a humidity.

5. The method of claim 1, wherein the detecting of the surrounding condition comprises detecting the surrounding condition from a resistance of the transfer roller.

6. The method of claim 1, wherein the detecting of the surrounding condition comprises detecting the surrounding from an electric current value of the transfer roller.

7. The method of claim 1, wherein the detecting of the surrounding condition comprises detecting the surrounding condition from a voltage value of the transfer roller.

8. The method of claim 1, wherein the detecting of the actual surrounding condition comprises detecting the actual surrounding condition from a resistance of a charge roller.

9. The method of claim 1, wherein the detecting of the actual surrounding condition comprises detecting the actual surrounding from an electric current value of a charge roller.

10. The method of claim 1, wherein the detecting of the actual surrounding condition comprises detecting the actual surrounding condition from a voltage value of a charge roller.

11. The method of claim 1, further comprising comparing a total number of printed pages with a threshold for a minimum number of printed pages.

12. An electrophotographic image forming apparatus comprising:

a laser scanning unit to generate a laser beam;

a photosensitive medium on which the laser beam is incident to form an electrostatic latent image;

a developing roller to attach toner to a surface of the photosensitive medium to develop the electrostatic latent image;

a transfer roller to transfer the developed image to a paper sheet;

a charge roller to charge the surface of the photosensitive medium to a predetermined voltage;

a power supply to supply electric power to the transfer roller and the charge roller;

a transfer roller resistance detecting unit to detect a resistance of the charge roller;

an actual surrounding condition detecting unit to detect an actual surrounding condition of the charge roller; and a controller to detect a surrounding condition from a resistance of the transfer roller, to compare the detected surrounding condition with the actual surrounding condition, and to generate a transfer roller exchange signal if the detected surrounding condition is not the same as the actual surrounding condition.

13. The electrophotographic image forming apparatus of claim 12, further comprising a display unit to indicate a time for a transfer roller exchange in response to the generated transfer roller exchange signal.

14. The electrophotographic image forming apparatus of claim 12, wherein the surrounding condition is a temperature.

15. The electrophotographic image forming apparatus of claim 12, wherein the surrounding condition is a humidity.

16. The electrophotographic image forming apparatus of claim 12, further comprising:

a power supply line between the power supply and the transfer roller; and an ammeter installed on the power supply line, wherein the transfer roller resistance detecting unit is the ammeter.

17. The electrophotographic image forming apparatus of claim 12, further comprising:

a power supply line between the power supply and the transfer roller; and a voltmeter installed on the power supply line, wherein the transfer roller resistance detecting unit is the voltmeter.

18. The electrophotographic image forming apparatus of claim 12, wherein the actual surrounding condition detecting unit is a charge roller resistance detecting unit to detect the resistance of the charge roller.

19. The electrophotographic image forming apparatus of claim 18, further comprising:

a power supply line between the power supply and the transfer roller; and a voltmeter installed on the power supply line, wherein the charge roller resistance detecting unit is the voltmeter.

20. The electrophotographic image forming apparatus of claim 18, further comprising:

a power supply line between the power supply and the transfer roller; and an ammeter installed on the power supply line, wherein the charge roller resistance detecting unit is the ammeter.

21. The electrophotographic image forming apparatus of claim 12, wherein the actual surrounding condition detecting unit is a thermometer to detect a temperature around the transfer roller.

22. The electrophotographic image forming apparatus of claim 12, further comprising a paper discharge sensor to sense a discharge of a printed paper sheet.

23. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller based on a detected condition of the charge roller;

a second detector to detect a reference surrounding condition of the transfer roller; and a controller to compare the reference surrounding condition with the actual surrounding condition.

24. The apparatus of claim 23, wherein the controller generates a transfer roller replacement signal if the reference surrounding condition is not equal to the actual surrounding condition.

25. The apparatus of claim 24, further comprising a display to display a transfer roller replacement message in response to the transfer roller replacement signal.

26. The apparatus of claim 23, wherein the actual and reference surrounding conditions are temperatures.

27. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the actual surrounding condition is determined from a resistance of the charge roller.

28. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the reference surrounding condition is determined from a resistance of the transfer roller.

29. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the first and second detectors are ammeters.

30. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the actual and reference surrounding conditions are humidities.

31. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the actual surrounding condition is determined from an electric current in the charge roller.

32. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the first and second detectors are voltmeters.

33. An apparatus comprising;

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition wherein the reference surrounding condition is determined from an electric current in the transfer roller.

34. An apparatus comprising:

a photosensitive medium;

a transfer roller to transfer an image from the photosensitive medium to a paper;

a charge roller to charge a surface of the photosensitive medium;

a first detector to detect an actual surrounding condition of the transfer roller;

a second detector to detect a reference surrounding condition of the transfer roller; and a controller to compare the reference surrounding condition with the actual surrounding condition, wherein the second detector is a thermometer.

35. A method comprising:

detecting a condition of a charge roller;

detecting a reference surrounding condition of a transfer roller;

detecting an actual surrounding condition of the transfer roller according to the detected condition of the charge roller; and determining a time to replace the transfer roller if the reference surrounding condition differs from the actual surrounding condition.

36. A method comprising:

detecting a reference surrounding condition of a transfer roller;

detecting an actual surrounding condition of a transfer roller; and determining a time to replace the transfer roller if the reference surrounding condition differs from the actual surrounding condition, wherein the determining the time to replace the transfer roller further comprises determining that a number of printed pages is greater than a predetermined number of printed pages.

* * * * *

UNITED STATES PATENT AND TRADEMARK OFFICE

CERTIFICATE OF CORRECTION

PATENT NO. : 7,016,618 B2
APPLICATION NO. : 10/693939
DATED : March 21, 2006
INVENTOR(S) : Su-jong Jeong It is certified that error appears in the above-identified patent and that said Letters Patent is hereby corrected as shown below:

Column 11, line 4, claim 33, replace “comprising;” with --comprising:--, therefor;

Column 11, line 15, claim 33, replace “condition” with --condition,-- therefor.

Signed and Sealed this

Twenty-second Day of August, 2006

JON W. DUDAS
*Director of the United States Patent and Trademark Office*